US006164286A

United States Patent [19]

Schad

[11] Patent Number: 6,164,286

[45] Date of Patent: Dec. 26, 2000

[54] SPRING ENHANCED CIGAR CUTTER

[75] Inventor: Clemens T. Schad, Aesch, Switzerland

[73] Assignee: Davidoff & Cie, SA, Geneve, Switzerland

[21] Appl. No.: 09/248,076

[22] Filed: Feb. 10, 1999

[51] Int. Cl.[7] ..... A24F 13/24; A24C 1/24

[52] U.S. Cl. ..... 131/248; 30/109; 30/111; 30/113

[58] Field of Search ..... 131/248, 252, 131/253, 233, 329; 30/109, 111, 112, 113, 278, 279.2

[56] References Cited

U.S. PATENT DOCUMENTS

| | | | |
|---|---|---|---|
| 1,166,881 | 1/1916 | Anderson | 30/113 |
| 1,199,784 | 10/1916 | Hall | 30/113 |
| 5,715,602 | 2/1998 | Hage | 30/113 |

*Primary Examiner*—James Derrington
*Assistant Examiner*—Dionne A. Walls
*Attorney, Agent, or Firm*—Darby & Darby

[57] ABSTRACT

The invention relates to a cutter for cutting the tip off a cigar. The cutter has a flat housing with mutually aligned openings which are arranged on a wide side of the housing and form a through-opening for inserting the cigar. The cutter further includes at least one flat blade 6 which is arranged in the housing and has lateral sliding surfaces 6*a*, 6*b* which are guided in an essentially straight path between corresponding mutually parallel guide surfaces 2*a*, 2*b* disposed in the housing. Also disposed in the housing is a resilient element 2 which is biased against one of the sliding surfaces 6*a* of the blade . The blade 6 can be moved with a handle 6*c* to slide the blade edge 6*d* into the plane of the through-opening. The resilient element has the form of a leaf spring 8 with a nose-shaped projection 9 which lockingly and releasably engages with a groove 6*e* formed in the sliding surface 6*a* of the blade when the blade (6, 7) is retracted.

2 Claims, 3 Drawing Sheets

SPRING ENHANCED CIGAR CUTTER

BACKGROUND OF THE INVENTION

The present invention relates to a cigar cutter for cutting off a tip of a cigar. The present disclosed cigar cutter is similar in the overall outside appearance of the cigar cutter as disclosed in application PCT/US97/16591, internationally filed on Sep. 17, 1997 and which application is incorporated by reference. The cutter has a flat housing with openings which are arranged on a wide side of the housing and aligned with each other, forming a through-opening for inserting the cigar. The cutter further includes at least one flat blade which is arranged in the housing and has lateral sliding surfaces which are guided in an essentially straight path between corresponding mutually parallel guide surfaces disposed in the housing. Also disposed in the housing is a resilient element which is biased against one of the sliding surfaces of the blade. The blade can be operated with a handle or handles to move the blade edge into the plane of the through-opening.

Cutters of this type for removing the tips from cigars are easy to operate and provide an excellent cut. The resilient element provides a slight bias to positively guide the blade. With the slight bias, the blade positively slides on a guide surface while a gap is provided between the blade and the other guide surface of the housing. This prevents the blade from jamming between the opposing guide surfaces of the housing, which would otherwise make guiding jerky. Consequently, only a small force needs to be applied between the guide surfaces of the housing to move the blade.

The cutter is carried by first sliding the blade fully into the housing so that the blade edge is located inside the housing. In this storage position, the blade is secured only by the slight bias produced by the spring. Disadvantageously, the blade can easily slide apart during transporting the cutter. The blade edge may slide into the through-opening causing injuries. For example, if a person carries the cutter in his/her pocket and tries to find the cutter with his/her hand, the person's finger might get caught and subsequently cut.

For safety reasons, conventional cutters have to be carried in a closed case to reduce the risk of injury.

With another known type of cutter, an increasingly stronger force has to be applied to move the blade into the final phase of the cutting operation. The increased force is necessary to positively engage a locking device at the same time the cigar tip is cut. The locking device prevents the blade from automatically sliding apart. Since a user may not always timely increase the force required to move the blade, the cutting process may be easily interrupted. The tobacco fibers are then not cleanly separated. In most cases, a user will then slide the blade fully apart and repeat the cut with a substantial thrust. The position of the cigar in the through-opening may also change during a second cut, so that the cigar is cut at another location. The cigar tip then tends to fray and the cut is not clean.

SUMMARY OF THE INVENTION

It is therefore an object of the invention to provide a cutter which can be easily manufactured, has excellent cutting characteristics, can easily handled and secured in the retracted carrying position and does not require a greater force to move the blade(s).

The object is solved according to the invention by forming the resilient element as a leaf spring with a nose-shaped projection which—in the retracted position of the blade— releasably and lockingly engages with a groove formed in one of the sliding surfaces of the blade.

This design has the advantage that the force for locking the blade need not be increased. The locking device is formed by the groove of the blade and the nose-shaped projection of the leaf spring. When the blade is pushed in, the projection engaging with the groove strongly draws the blade in when the cut is almost completed. The last phase of the cut occurs almost automatically. The user need apply only a small force to finish the cut.

Advantageously, a relatively large force is required for moving the blade outwardly, thus preventing the blade from moving outwardly by itself.

The performance of the cutter can be improved by providing in the housing two blades which can be moved through the through-opening in opposite directions and which cut past one another. When the blades are pushed in, the tobacco fibers of the cigar are advantageously pushed inwardly towards the inside of the cigar from two edges. The marginal edge of the cut cigar is clean all around without producing frayed tobacco fibers.

With a cutter having only one blade, the tobacco fibers can only be severed across the entire cross-section of the cigar by moving the blade through the cigar from one marginal edge to the other. Frayed tobacco fibers are pushed outwardly at the marginal edge where the blade exits from the cigar. This causes a poor and asymmetric cut, and causes the cigar to burn predominantly on one side.

By providing two blades, each blade advantageously cuts only half the cross section of the cigar; only half the time is needed to cut the entire cross-section of the cigar as compared to a single blade.

It is particularly advantageous if a common leaf spring is provided for both blades which contacts one of the sliding surfaces of each of the blades. This reduces the number of components for such cutter and therefore also the manufacturing costs.

According to another advantageous feature, the common leaf spring is slotted along its longitudinal direction and connected only at its respective ends, thereby providing the same effect as two separate juxtaposed leaf springs. Without the slot, the leaf spring may make contact with the sliding surface of only one of the blades while leaving a gap with the sliding surface of the other blade due to manufacturing tolerances of the blade or the housing. One of the blades may then be guided with a spring bias and slide easily. Conversely, the other blade would jam within the existing gap and move jerkily.

Simply by providing a slot in the leaf spring and thereby producing two functional juxtaposed leaf springs, both blades are reliably pre-biased and accurately guided, and can be safely locked.

To facilitate installation, the housing can be composed of two housing sections, which are advantageously formed as flat base plates with narrow side walls and connected with each other through cooperating connecting means.

On those sides of the housing sections where the blades penetrate the housing, the side walls advantageously include recesses for receiving the blades. The side walls located opposite from the recesses advantageously have ribs formed therein. When the housing sections of the cutter are assembled, the recess of one housing section and the rib of the respective other housing section form an insertion opening for one of the blades.

The blade advantageously includes a narrow region, which corresponds to the width of the insertion opening and can slide within the insertion opening, and a wider region which can slide within the housing. The wider region of the blade strikes the side wall with the insertion opening when the blade is moved outwardly. This feature prevents removal of the blade from the housing.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the drawings, wherein like reference numerals delineate similar elements throughout the several views.

DETAILED DESCRIPTION OF THE PRESENTLY PREFERRED EMBODIMENTS

Figure 1:
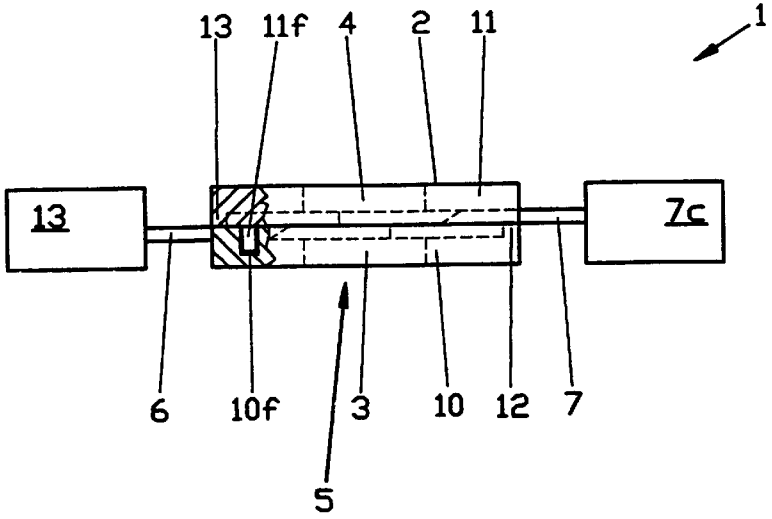
FIG. 1 shows a side view of a cutter with two knives.

Referring now to the drawing, the cutter 1 includes a flat housing 2, wherein the wide sides of the housing 1 include mutually aligned openings 3 and 4 which form a through-opening 5 for inserting the cigar. The housing 1 further includes two blades 6 and 7 having lateral sliding surfaces 6*a*, 6*b* and 7*a*, 7*b*, respectively, which are guided in an essentially straight path between associated parallel guide surfaces 2*a* and 2*b* of the housing 2. A leaf spring 8 with a nose-shaped projection 9 is also located in the housing 2. The leaf spring 8 is biased against a respective one of the sliding surfaces 6*a* and 7*a* of each of the blades 6 and 7. The blades 6 and 7 can be operated by a respective handle 6*c* and 7*c* adapted to slide the blade edges 6*d* and 7*d* of the blades 6 and 7 into the plane of the through-opening 5.

Figure 4:
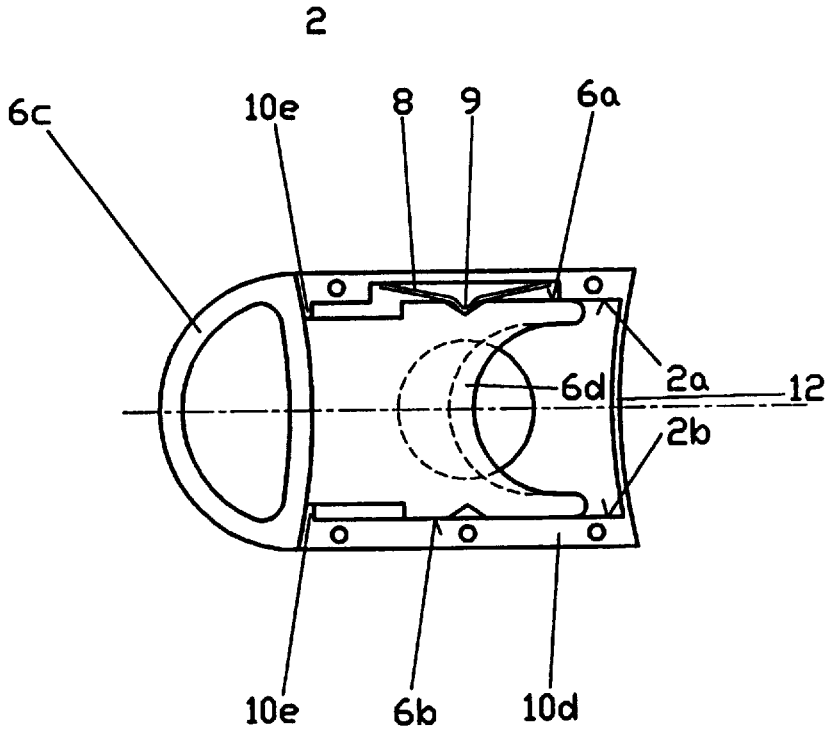
FIG. 4 shows the lower housing section of a cutter with one installed blade.

In the retracted position of the blades 6 and 7, the nose-shaped projection 9 of the leaf spring 8 releasably and lockingly engages with a groove 6*e* formed in the sliding surface 6*a* of the blade 6, as seen in FIG. 4. The groove 6*e* is provided with a beveled surface 6*f*. When the groove 6*e* or 7*e* moves into the region of the projection 9 of the leaf spring 8, the beveled surface 6*f*, 7*f* of the groove 6*e*, 7*e* produces a force which acts along the movement direction of the blades 6 and 7 and automatically retracts the knives 6 and 7. The projection 9 of the leaf spring 8 moves translationally in the plane of the blades 6 and 7 and perpendicular to the movement direction of the blades. The bias of the leaf spring 8 provides the driving force for retracting the blades 6 and 7.

The blades 6 and 7 include semicircular blade edges 6*d* and 7*d* which are sharpened on one side. Both blades are of identical construction and can be interchanged. This is feasible because the groove 6*e*, 7*e* is formed on both sliding surfaces 6*a*, 6*b* and 7*a*, 7*b*, respectively.

The cutter is composed of two housing sections 10 and 11. The upper housing section 11 is not shown in FIGS. 2, 3 and 4 to simplify the drawing. The housing sections 10 and 11 are formed as flat base plates 10*a* with narrow side walls 10*b*, 10*c*, 10*d* and 10*e* and secured to each other through cooperating connecting means.

In the present example, projections 11*f* disposed on the side walls of one housing section 11 and recesses 10*f* associated with the projections 11*f* and disposed on the side walls of the other housing section 10 form the connecting means, wherein the projections 11*f* are inserted and anchored in the recesses 10*f*.

Each of the two housing sections 10 and 11 has a pocket-shaped recess 10*g* in the respective region of a side wall 10*b* which forms a guide surface. When the two housing sections 10 and 11 are assembled, the two recesses are located side-by-side and form a receiving pocket for receiving the leaf spring 8.

The flat base plates 10*a* and 11*a* are provided with the openings 3 and 4 which are aligned opposite to each other and form the through-opening 5 for inserting the cigar when the cutter is fully assembled. The openings 3 and 4 are arranged approximately in the center of the flat base plates 10*a* and 11*a*. The side walls of the housing sections 10 and 11 which form the guide surfaces for the blades 6 and 7, have the same height as the respective blades 6, 7. The blades 6 and 7 are installed by positioning the blades on the ground plates 10*a* and 11*a* between the side walls. The side walls 10*e* have openings 10*h* for receiving the blades 6 and 7 on those sides of the housing sections 10 and 11, where the blades are inserted in the housing 2. The side walls 10*c* and 11*c* facing the openings 10*h* form ribs 12 and 13. The opening 10*h* of one housing section 10 and the rib 13 of the other housing section 11 form an insertion opening for a blade 6 or 7, respectively, when the cutter is assembled. Consequently, in the assembled state, two insertion openings are provided for guiding the two blades 6 and 7. The ribs 12 and 13 limit the clearance of the blades 6 and 7 in the direction perpendicular to the plane of the blades 6 and 7.

Figure 3:
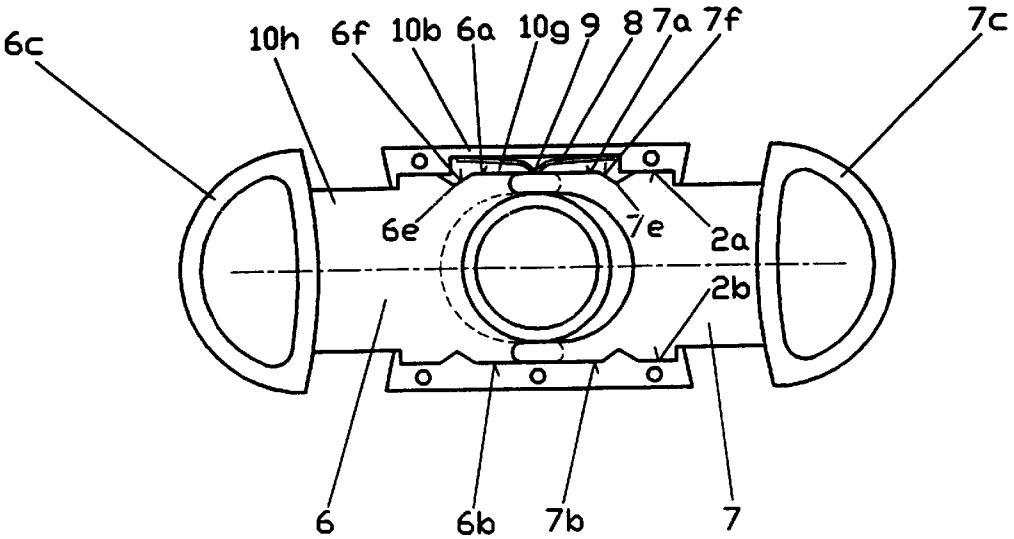
FIG. 3 shows a cutter, with the upper housing section omitted.
Figure 2:
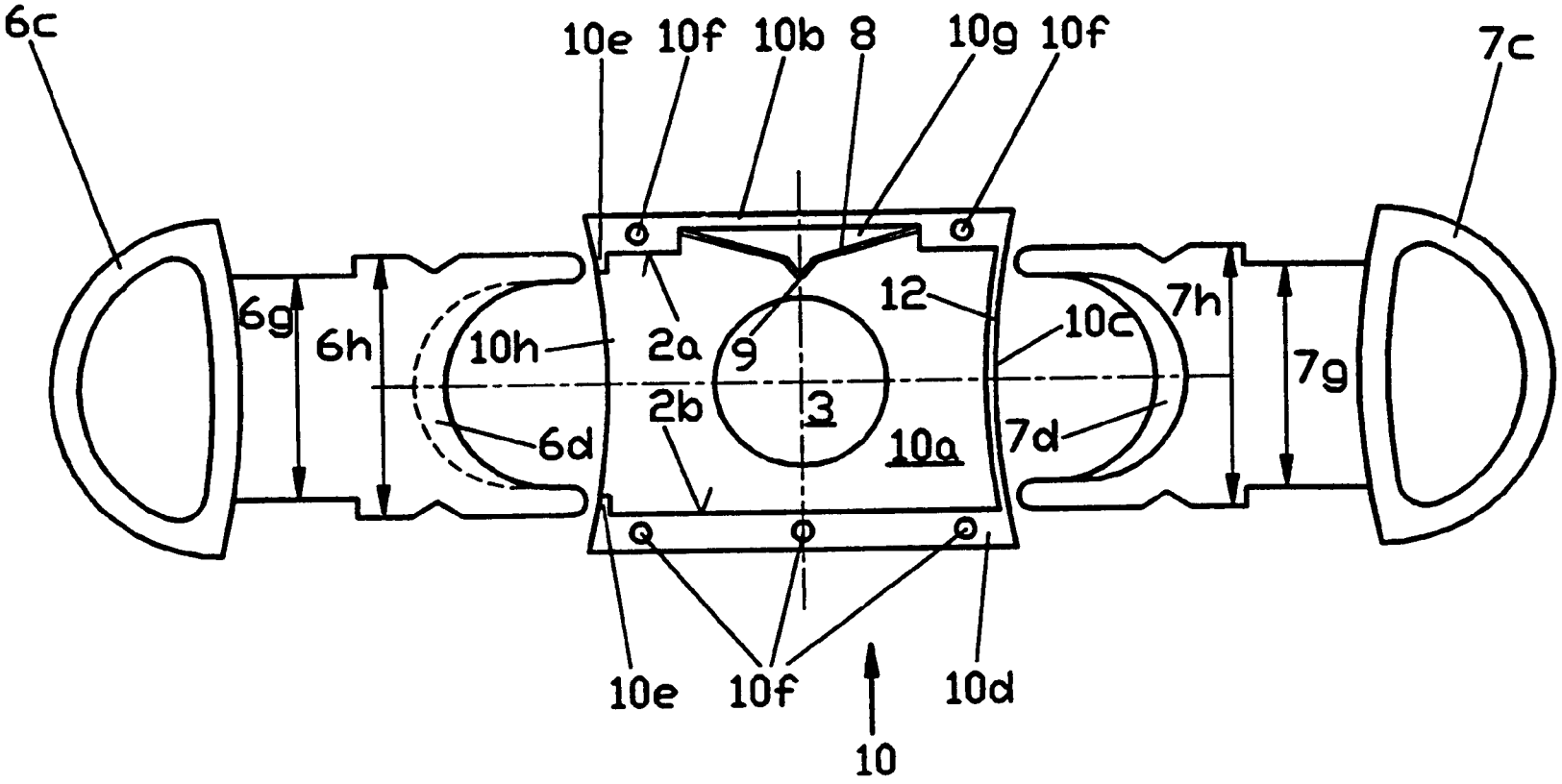
FIG. 2 shows the lower housing section of a cutter with two blades, before the two blades are installed.

FIGS. 2, 3 and 4 illustrate a simple leaf spring 8 which contacts the juxtaposed sliding surfaces 6*a* and 7*a* of the blades 6 and 7. The width b of the leaf spring 8 corresponds approximately to the total width of the juxtaposed sliding surfaces 6*a* and 7*a* of the blades 6 and 7.

Figure 5A:
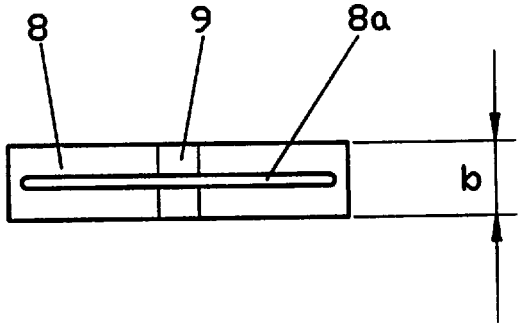
FIGS. 5*a* and 5*b* show two views of a slotted leaf spring of a cutter according to the invention.
Figure 5B:
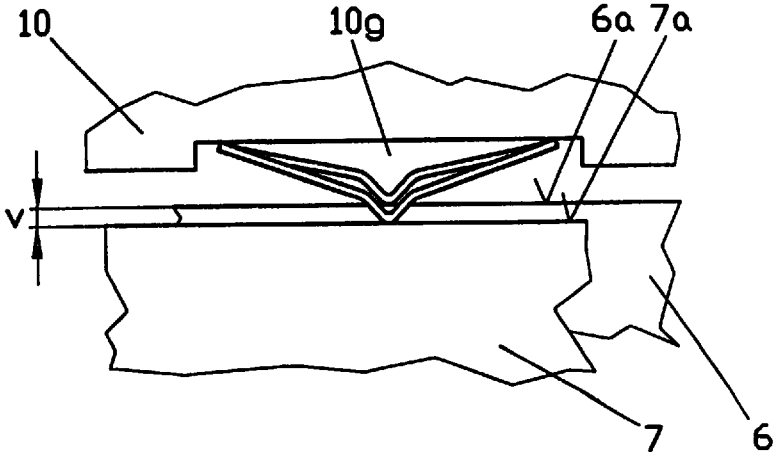

FIGS. 5*a* and 5*b* illustrate a special leaf spring 8 with a slot 8*a* extending in the longitudinal direction. The leaf spring 8 is connected only at its respective ends, thereby providing the same effect as two separate leaf springs positioned side-by-side.

The slotted leaf spring 8 always pre-biases the sliding surfaces 6*a* and 7*a* of both blades 6 and 7, even when the blades are offset from each other by an offset v. This eliminates any unwanted gap between the leaf spring 8 and one of the sliding surfaces 6*a* and 7*a*, respectively.

Each blade 6 and 7 includes a narrow region 6*g* and 7*g*, respectively, which corresponds to the width of the insertion opening and can be moved in the insertion opening. A wider region 6*h* and 7*h*, respectively, which can be moved within the housing 2, abuts the narrow region. The wider region 6*h* of the blade 6, for example, strikes the inside of the side wall 10*e* when the blade is moved outwardly, so that the blade cannot be removed from the housing. The same applies to the blade 7 and the housing section 11.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A cigar cutter comprising:

a housing (2) defining an interior cavity (5), and an aperture (3, 4) sized to permit a cigar end to be inserted;

a first cutting element (6) having a sharpened edge (6*d*), said first cutting element slidably disposed on first lateral sliding surfaces (6*a*, 6*b*) within said housing and adapted for moving said sharpened edge relative to said aperture defined in said housing;

a second cutting element (7) having a sharpened edge (7*d*), said second cutting element slidably disposed on second lateral sliding surfaces (7*a*, 7*b*) within said housing and adapted for moving said sharpened edge of said cutting element relative to said aperture defined in said housing;

the first and second lateral sliding surfaces (6*a*, 6*b*, 7*a*, 7*b*) are arranged in the housing (2) along a substantially straight path between mutually parallel guide surfaces (2*a*, 2*b*) and associated with the sliding surfaces (6*a*, 6*b*, 7*a*, 7*b*);

a resilient leaf spring (8) disposed in the housing (2) and biased against one of the sliding surfaces (6*a*, 7*a*) of the first and second cutting element (6, 7);

handles (6*c*, 7*c*) operatively associated with said first and second cutting element for displacing said first and second cutting element towards and away from each other to form a retracted position and a cigar receiving position;

the resilient leaf spring (8) having a nose-shaped projection (9) which lockingly and releasably engages with a groove (6*e*, 7*e*) formed in each sliding surface (6*a*, 7*a*) of the first and second cutting elements (6, 7).

2. A cigar cutter comprising:

a housing (2) defining an interior cavity (5), and an aperture (3, 4) sized to permit a cigar end to be inserted;

a first cutting element (6) having a sharpened edge (6*d*), said first cutting element slidably disposed on first lateral sliding surfaces (6*a*, 6*b*) within said housing and adapted for moving said sharpened edge relative to said aperture defined in said housing;

a second cutting element (7) having a sharpened edge (7*d*), said second cutting element slidably disposed on second lateral sliding surfaces (7*a*, 7*b*) within said housing and adapted for moving said sharpened edge of said cutting element relative to said aperture defined in said housing:

the first and second lateral sliding surfaces (6*a*, 6*b*, 7*a*, 7*b*) are arranged in the housing (2) along a substantially straight path between mutually parallel guide surfaces (2*a*, 2*b*) and associated with the sliding surfaces (6*a*, 6*b*, 7*a*, 7*b*);

a resilient element (8) disposed in the housing (2) and biased against one of the sliding surfaces (6*a*, 7*a*) of the first and second cutting element (6, 7);

handles (6*c*, 7*c*) operatively associated with said first and second cutting element for displacing said first and second cutting element towards and away from each other to form a retracted position and a cigar receiving position;

the resilient element (8) having a nose-shaped projection (9) which lockingly and releasably engages with a groove (6*e*, 7*e*) formed in each sliding surface (6*a*, 7*a*) of the first and second cutting elements (6, 7);

wherein the resilient element (8) is a leaf spring (8) which contacts the sliding surfaces (6*a*, 7*a*) of each cutting element (6, 7) and wherein the leaf spring (8) is slotted along its longitudinal direction, providing two spring halves, one half is biased against the first cutting element and the other half is biased against the second cutting element.

* * * * *